US012013164B2

(12) United States Patent
Zhu et al.

(10) Patent No.: US 12,013,164 B2
(45) Date of Patent: Jun. 18, 2024

(54) REFRIGERATION SYSTEM WITH A PLURALITY OF STEAM EJECTORS CONNECTED TO A PLURALITY OF FLOW TRAPS

(71) Applicant: CARRIER CORPORATION, Palm Beach Gardens, FL (US)

(72) Inventors: Yonghua Zhu, Cork (IE); Marcello Torchio, Cork (IE)

(73) Assignee: CARRIER CORPORATION, Palm Beach Gardens, FL (US)

( * ) Notice: Subject to any disclaimer, the term of this patent is extended or adjusted under 35 U.S.C. 154(b) by 156 days.

(21) Appl. No.: 17/253,169

(22) PCT Filed: Jul. 30, 2020

(86) PCT No.: PCT/US2020/044160
§ 371 (c)(1),
(2) Date: Dec. 17, 2020

(87) PCT Pub. No.: WO2021/034469
PCT Pub. Date: Feb. 25, 2021

(65) Prior Publication Data

US 2022/0299239 A1 Sep. 22, 2022

Related U.S. Application Data

(60) Provisional application No. 62/888,824, filed on Aug. 19, 2019.

(51) Int. Cl.
*F25B 9/08* (2006.01)
*F25B 41/24* (2021.01)

(52) U.S. Cl.
CPC ..... *F25B 9/08* (2013.01); *F25B 41/24* (2021.01); *F25B 2341/0012* (2013.01); *F25B 2341/0015* (2013.01); *F25B 2400/23* (2013.01)

(58) Field of Classification Search
CPC .... F25B 9/08; F25B 41/24; F25B 2341/0012; F25B 2341/0015; F25B 2400/23
USPC ..... 62/115
See application file for complete search history.

(56) References Cited

U.S. PATENT DOCUMENTS

| | | | | |
|---|---|---|---|---|
| 1,836,318 | A | 7/1926 | Gay | |
| 8,628,025 | B2 | 1/2014 | Bucknell | |
| 9,657,969 | B2 | 5/2017 | Vaisman et al. | |
| 11,149,989 | B2 * | 10/2021 | Wang | F25B 41/00 |

(Continued)

FOREIGN PATENT DOCUMENTS

| | | | |
|---|---|---|---|
| CN | 205261972 | U | 5/2016 |
| JP | 1089814 | A | 4/1998 |
| JP | 3209927 | B2 * | 9/2001 |

(Continued)

OTHER PUBLICATIONS

International Search Report; International Application No. PCT/US2020/044160; International Filing Date: Jul. 30, 2020; Date of Mailing: Nov. 9, 2020; 5 pages.

(Continued)

*Primary Examiner* — Raheena R Malik
(74) *Attorney, Agent, or Firm* — CANTOR COLBURN LLP

(57) ABSTRACT

Disclosed is a refrigeration system having: a steam ejector with an ejector outlet; and a passive flow trap connected to the ejector outlet.

15 Claims, 2 Drawing Sheets

(56) References Cited

U.S. PATENT DOCUMENTS

2012/0167601 A1* 7/2012 Cogswell ..... F25B 41/22
62/115

FOREIGN PATENT DOCUMENTS

| | | | |
|---|---|---|---|
| JP | 2006234225 | A | 9/2006 |
| WO | 2012012488 | A1 | 1/2012 |
| WO | 2017007585 | A1 | 1/2017 |

OTHER PUBLICATIONS

Written Opinion; International Application No. PCT/US2020/044160; International Filing Date: Jul. 30, 2020; Date of Mailing: Nov. 9, 2020; 8 pages.

* cited by examiner

REFRIGERATION SYSTEM WITH A PLURALITY OF STEAM EJECTORS CONNECTED TO A PLURALITY OF FLOW TRAPS

CROSS REFERENCE TO RELATED APPLICATIONS

This application is a National Stage application of PCT/US2020/044160, filed Jul. 30, 2020, which claims the benefit of U.S. Application No. 62/888,824, filed on Aug. 19, 2019, both of which are incorporated by reference in their entirety herein.

BACKGROUND

The disclosed embodiments related to refrigeration systems and more specifically to a refrigeration systems that includes a plurality of steam ejectors and a plurality of flow traps.

Commercial refrigeration systems (CRSs) represent a significant part of a power load in super markets. Steam ejectors are convergent-divergent devices that provide a pressure lift without requiring power and thereby are used to increase CRS efficiency. In order to satisfy different load conditions, parallel multi-ejectors configurations (with a same or different sizes) may be installed in a CRS. However, when multiple ejectors operate at the same time, there may be risks of unstable operations, for example, reverse flow (RF), due to different operating characteristics and output capacities among the ejectors.

BRIEF SUMMARY

Disclosed is a refrigeration system comprising: a steam ejector with an ejector outlet; and a passive flow trap connected to the ejector outlet.

In addition to one or more of the above disclosed aspects or as an alternate the passive flow trap includes an inlet-side drop, a center bend, and an outlet-side rise, thereby defining a U shape.

In addition to one or more of the above disclosed aspects or as an alternate the inlet-side drop is larger than the outlet-side rise.

In addition to one or more of the above disclosed aspects or as an alternate, the system includes a separator connected to an outlet-side of the passive flow trap.

In addition to one or more of the above disclosed aspects or as an alternate the passive flow trap is connected to a lower portion of the separator that is configured to store liquid refrigerant.

Disclosed is a refrigeration system, comprising: a plurality of steam ejectors, each of which including one of a plurality of ejector outlets; and a plurality of passive flow traps, one of which connected to each of the plurality of ejector outlets.

In addition to one or more of the above disclosed aspects or as an alternate each of the plurality of passive flow traps includes an inlet-side drop, a center bend, and an outlet-side rise, thereby defining a U shape.

In addition to one or more of the above disclosed aspects or as an alternate for at least one of the plurality of passive flow traps, the inlet-side drop is larger than the outlet-side rise.

In addition to one or more of the above disclosed aspects or as an alternate for at least two of the plurality of passive flow traps, the outlet-side rise is the same.

In addition to one or more of the above disclosed aspects or as an alternate for each of the plurality of passive flow traps, the outlet-side rise is the same.

In addition to one or more of the above disclosed aspects or as an alternate for each of the plurality of passive flow traps, the outlet-side rise is different.

In addition to one or more of the above disclosed aspects or as an alternate, the system includes a separator connected to an outlet-side of each of the plurality of passive flow traps.

In addition to one or more of the above disclosed aspects or as an alternate the plurality of passive flow traps are connected to a lower portion of the separator that is configured to store liquid refrigerant.

In addition to one or more of the above disclosed aspects or as an alternate, the system includes an evaporator, wherein each of the plurality of steam ejectors includes one of a plurality of ejector first-inlets, each of the plurality of ejector first-inlets is connected to the evaporator.

In addition to one or more of the above disclosed aspects or as an alternate, the system includes a plurality of shut-off valves, wherein each of a plurality of shut off valves is connected between the evaporator and one of the plurality of ejector first-inlets.

In addition to one or more of the above disclosed aspects or as an alternate the separator includes a first outlet connected to the evaporator.

In addition to one or more of the above disclosed aspects or as an alternate, the system includes a gas cooler, wherein each of the plurality of steam ejectors includes one of a plurality of ejector second-inlets, each of the plurality of ejector second-inlets is connected to the gas cooler.

In addition to one or more of the above disclosed aspects or as an alternate, the system includes a compressor, wherein the separator includes a second outlet connected to the compressor.

Disclosed is a method of directing flow in a refrigerant system comprising: directing a two phase flow from each of a plurality of steam ejectors into one of a plurality of passive flow traps; directing the two phase flow from each of the plurality of passive flow traps into a separator; and preventing backflow from the separator from reaching each of the plurality of steam ejectors with one of the plurality of passive flow traps.

In addition to one or more of the above disclosed aspects or as an alternate each of the plurality of passive flow traps includes an inlet-side drop, a center bend, and an outlet-side rise, thereby defining a U shape.

BRIEF DESCRIPTION OF THE DRAWINGS

The present disclosure is illustrated by way of example and not limited in the accompanying figures in which like reference numerals indicate similar elements.

DETAILED DESCRIPTION

Figure 1:
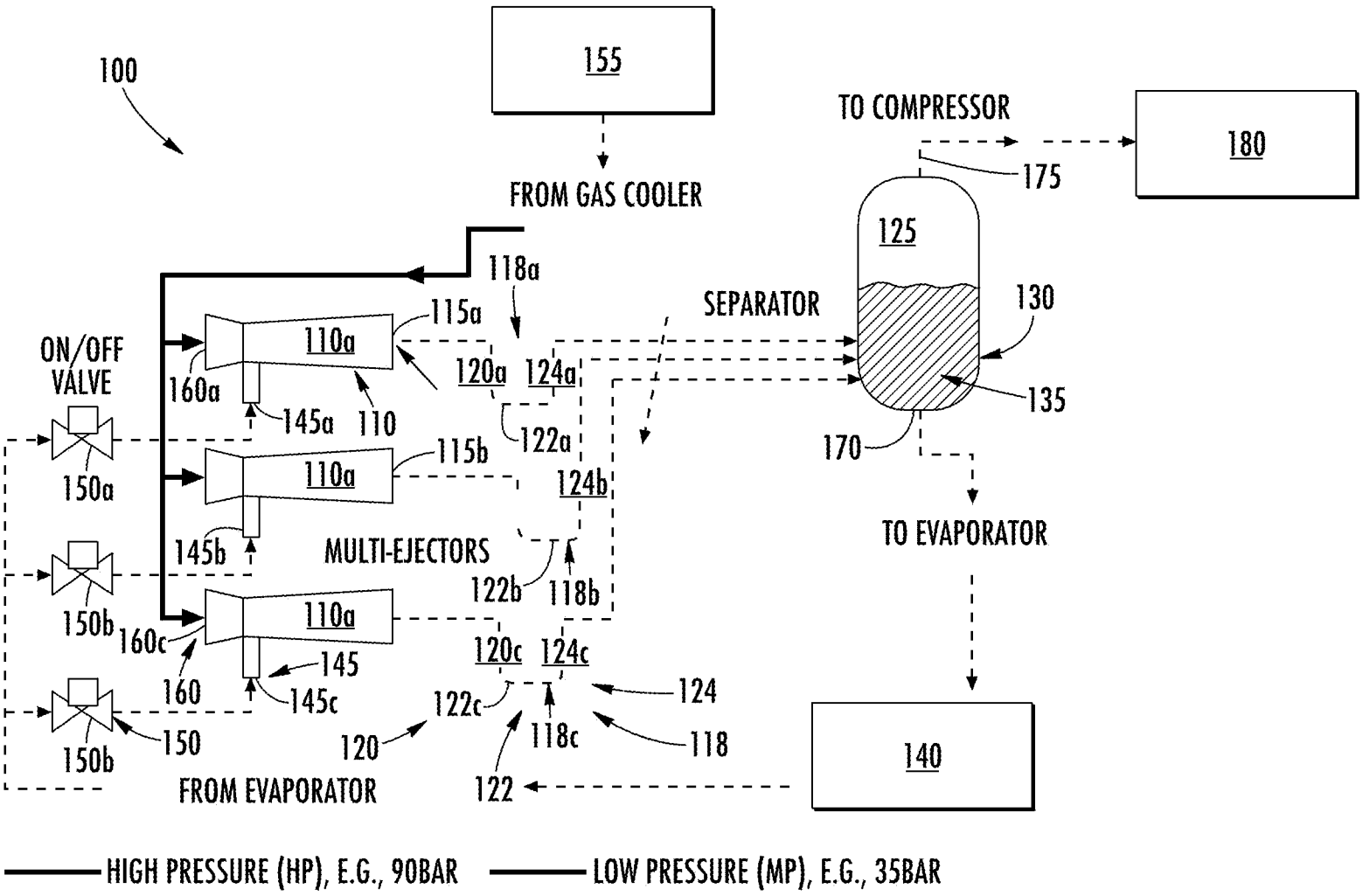
FIG. 1 is a schematic illustration of a refrigerant system according to an embodiment.

Turning to FIG. 1, the disclosed embodiments provide a configuration for a refrigeration system (system) 100 with a plurality of steam ejectors 110, wherein backflow from a separator 120 may be minimized. The plurality of steam ejectors 110 are illustrated as including three ejectors 110*a*-110*c* each with one of a plurality of ejector outlets 115 so that three outlets 115*a*-115*c* are illustrated. Each of the ejector outlets 115 is connected to one of a plurality of passive flow traps 118 so that three passive flow traps 118*a*-118*c* are illustrated. Though sets of three features are illustrated and disclosed herein, such as three steam ejectors 110 and passive flow traps 118, the disclosure is not intended to limit the scope of a number of features that may fall within the scope of the disclosure and appended claims.

Each of the passive flow traps 118 includes an inlet-side drop (relative to gravity) 120, a center bend 122 and an outlet-side rise (relative to gravity) 124 so as to define a U shape. Accordingly, three inlet-side drops 120*a*-120*c*, three center bends 122*a*-122*c* and three outlet-side rises 124*a*-124*c* are illustrated. A separator 125 is connected the outlet-side rise 124 of each of the passive flow traps 118. More specifically, the passive flow traps 118 are connected to a lower portion 130 of the separator 125 that normally contains accumulated liquid refrigerant 135.

A height span of each of the outlet-side rises 124*a*-124*c* can be a same distance or a different distance for each of the plurality of steam ejectors 110. There will typically be at least some liquid stored in one of the passive flow traps 118 if outlet pressure of the respective one of the steam ejectors 110 is lower than pressure at the separator 120. Such fluid in the traps 118 prevents backflow. That is, in such situation, the passive flow traps 118 each functions as a pressure buffer to avoid reverse flow from the separator 125. According to hydrostatic pressure theory, the static pressure provided by the U-shape could be estimated by $p=\rho gh$, where $\rho$, g and h are density of liquid refrigerant, gravitational constant and height of outlet-side rise, respectively. As long as the pressure difference between ejector outlet and separator is lower than this value, the reverse flow may be avoided.

As further illustrated, the system 100 includes an evaporator 140, illustrated schematically. Each of the plurality of steam ejectors 110 includes one of a plurality of ejector first-inlets 145 so that three of the ejector first-inlets 145*a*-145*c* are illustrated. Each of the ejector first-inlets 145 is connected to the evaporator 140. Further, each of a plurality of shut-off valves 150 is connected between the evaporator 140 and one of the ejector first-inlets 145, so that three shut-off valves 150*a*-150*c* are illustrated.

The system further includes a gas cooler 155 illustrate schematically. Each of the plurality of steam ejectors 110 includes one of a plurality of ejector second-inlets 160 so that three of the ejector second-inlets 160*a*-160*c* are illustrated. Each of the ejector second-inlets 160 is connected to the gas cooler 155. The separator 125 includes a first outlet 170 connected to the evaporator and a second outlet 175 connected to a compressor 180 of the system 100.

Figure 2:
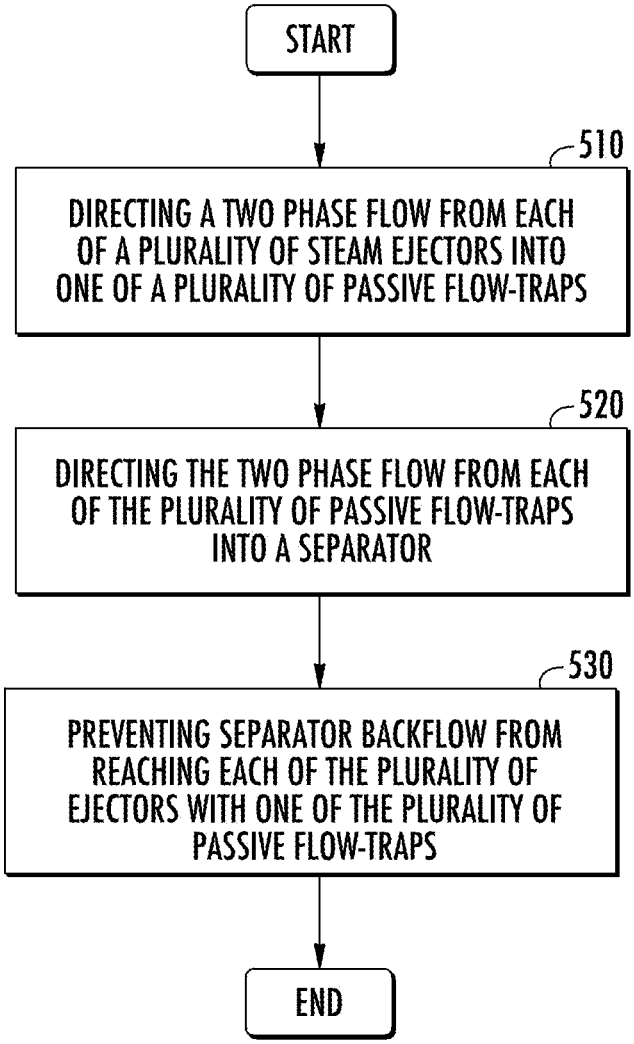
FIG. 2 is a flow diagram showing a process of directing flow in a refrigerant system according to an embodiment.

Turning to FIG. 2, a method is shown in a flow chart of directing flow in the system 100. As illustrated in block 510, the method includes directing a two phase flow from each of a plurality of steam ejectors 110 into one of a plurality of passive flow traps 118. As illustrated in block 520, the method includes directing the two phase flow from each of the plurality of passive flow traps 118 into a separator 125. As illustrated in block 530, the method includes preventing separator backflow from reaching each of the plurality of steam ejectors 110 with one of the plurality of passive flow traps 118.

The above disclosed embodiments provide a system 100 that mitigates a possibility of reverse flow from the separator 125 to the plurality of steam ejectors 110. The system 100 may increase an operating efficiency associated with utilizing a multi-ejector configuration while minimizing a risk of reverse flow.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

Those of skill in the art will appreciate that various example embodiments are shown and described herein, each having certain features in the particular embodiments, but the present disclosure is not thus limited. Rather, the present disclosure can be modified to incorporate any number of variations, alterations, substitutions, combinations, subcombinations, or equivalent arrangements not heretofore described, but which are commensurate with the scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

What is claimed is:

1. A refrigeration system comprising:

a steam ejector with an ejector outlet; and a passive flow trap connected to the ejector outlet, wherein:

the passive flow trap includes an inlet-side drop, a center bend, and an outlet-side rise, thereby defining a U shape, and the inlet-side drop is larger than the outlet-side rise.

2. The system of claim 1, comprising a separator connected to an outlet-side of the passive flow trap.

3. The system of claim 2, wherein the passive flow trap is connected to a lower portion of the separator that is configured to store liquid refrigerant.

4. A refrigeration system, comprising:

a plurality of steam ejectors, each of which including one of a plurality of ejector outlets; and a plurality of passive flow traps, one of which connected to each of the plurality of ejector outlets, wherein:

each of the plurality of passive flow traps includes an inlet-side drop, a center bend, and an outlet-side rise, thereby defining a U shape, and for at least one of the plurality of passive flow traps, the inlet-side drop is larger than the outlet-side rise.

5. The system of claim 4, wherein for at least two of the plurality of passive flow traps, the outlet-side rise is the same.

6. The system of claim 4, wherein for each of the plurality of passive flow traps, the outlet-side rise is the same.

7. The system of claim 4, wherein for each of the plurality of passive flow traps, the outlet-side rise is different.

8. The system of claim 4, comprising a separator connected to an outlet-side of each of the plurality of passive flow traps.

9. The system of claim 8, wherein the plurality of passive flow traps are connected to a lower portion of the separator that is configured to store liquid refrigerant.

10. The system of claim 9, including an evaporator, wherein each of the plurality of steam ejectors includes one of a plurality of ejector first-inlets, each of the plurality of ejector first-inlets is connected to the evaporator.

11. The system of claim 10, including a plurality of shut-off valves, wherein each of a plurality of shut off valves is connected between the evaporator and one of the plurality of ejector first-inlets.

12. The system of claim 11, wherein the separator includes a first outlet connected to the evaporator.

13. The system of claim 12, including a gas cooler, wherein each of the plurality of steam ejectors includes one of a plurality of ejector second-inlets, each of the plurality of ejector second-inlets is connected to the gas cooler.

14. The system of claim 13, including a compressor, wherein the separator includes a second outlet connected to the compressor.

15. A method of directing flow in the refrigerant system of claim 4, comprising:

directing a two phase flow from each of the plurality of steam ejectors into one of the plurality of passive flow traps;

directing the two phase flow from each of the plurality of passive flow traps into a separator; and preventing backflow from the separator from reaching each of the plurality of steam ejectors with one of the plurality of passive flow traps.

* * * * *